US007722287B2

(12) United States Patent
Swank

(10) Patent No.: US 7,722,287 B2
(45) Date of Patent: May 25, 2010

(54) RESILIENT ATHLETIC FLOORING SURFACE

(75) Inventor: Kevin Swank, Austin, TX (US)

(73) Assignee: Fieldturf Tarkett Inc., Montreal (CA)

( * ) Notice: Subject to any disclaimer, the term of this patent is extended or adjusted under 35 U.S.C. 154(b) by 0 days.

(21) Appl. No.: 11/698,800

(22) Filed: Jan. 26, 2007

(65) Prior Publication Data

US 2008/0072513 A1 Mar. 27, 2008

Related U.S. Application Data

(60) Provisional application No. 60/847,053, filed on Sep. 25, 2006.

(51) Int. Cl.
*E01C 13/08* (2006.01)

(52) U.S. Cl. ..... 404/73; 404/31

(58) Field of Classification Search ..... 404/2, 404/29–47, 72–82

See application file for complete search history.

(56) References Cited

U.S. PATENT DOCUMENTS

| | | | | |
|---|---|---|---|---|
| 4,095,388 | A * | 6/1978 | Breault | 52/747.11 |
| 4,227,201 | A * | 10/1980 | Grinberg et al. | 349/41 |
| 4,907,387 | A | 3/1990 | Turnbull | |
| 4,973,505 | A * | 11/1990 | Bielous | 428/44 |
| 5,199,815 | A * | 4/1993 | Inoue et al. | 404/18 |
| 5,234,738 | A * | 8/1993 | Wolf | 428/120 |
| 5,906,454 | A * | 5/1999 | Medico et al. | 404/32 |
| 6,206,607 | B1 * | 3/2001 | Medico et al. | 404/2 |
| 6,616,542 | B1 * | 9/2003 | Reddick | 473/171 |
| 6,779,946 | B1 * | 8/2004 | Urriola et al. | 405/43 |
| 6,796,096 | B1 * | 9/2004 | Heath | 52/403.1 |
| 6,966,161 | B2 * | 11/2005 | Palsson et al. | 52/589.1 |
| 7,273,642 | B2 * | 9/2007 | Prevost | 428/17 |
| 2004/0139678 | A1 * | 7/2004 | Pervan | 52/578 |
| 2005/0129906 | A1 | 6/2005 | Knox | |
| 2005/0191126 | A1 * | 9/2005 | Amelung, Sr. | 404/36 |
| 2006/0034654 | A1 * | 2/2006 | Sanders | 404/40 |
| 2006/0039754 | A1 * | 2/2006 | Linville | 404/73 |
| 2006/0105847 | A1 * | 5/2006 | Stroppiana | 472/85 |
| 2008/0145574 | A1 * | 6/2008 | Julicher et al. | 428/17 |

FOREIGN PATENT DOCUMENTS

JP 5-272110 * 3/1992

OTHER PUBLICATIONS

PCT International Search Report for PCT/US07/20706, International Filing Date Sep. 25, 2007, 2 pages.
PCT Written Opinion o the International Searching Authority for PCT/US07/20706, International Filing Date Sep. 25, 2007, 4 pages.

* cited by examiner

*Primary Examiner*—Raymond W Addie
(74) *Attorney, Agent, or Firm*—Factor & Lake, Ltd.

(57) ABSTRACT

An athletic surface having a resilient layer operatively positioned on the supporting structure including a top playing surface; and a bottom surface associated with the supporting base structure. The bottom surface associated with the supporting base structure includes a first side surface and a second side surface, both of which extend in the longitudinal direction of the layer. The said bottom surface also includes a first end surface and a second end surface, both of which extend in the transverse direction of the layer. The top playing surface of the athletic flooring system includes a drainage facilitating means associated with the top surface.

15 Claims, 1 Drawing Sheet

RESILIENT ATHLETIC FLOORING SURFACE

CROSS REFERENCE TO RELATED APPLICATIONS

This application claims the benefit of U.S. Provisional Application No. 60/847,053, filed Sep. 25, 2006; the contents of which are incorporated herein by reference.

BACKGROUND OF THE INVENTION

This invention relates in general to athletic running and playing surfaces.

Athletic running and playing surfaces have long been known in the art. Because the conventional athletic flooring surfaces are often installed outdoors, they are exposed to the natural elements, including rain. Accordingly, adequate drainage of water off of the surface is important.

Conventional resilient running tracks (such as shown in FIG. 1) have edges that have butt joints (or straight edges), and when the tracks are laid down, a series of tracks are abutted together to form a continuous surface. Adhesives of known kinds typically used to bind resilient materials have been contemplated to assist in securing the straight edges together. However, the use of adhesive has not proved satisfactory since, among other things, a portion of the adhesive tends to squeeze out of the seam and onto the exposed surfaces of the running track.

Additionally, since the conventional running tracks have straight edges, problems have occurred as a result of water seeping between the edges and ultimately under and below the bottom surfaces of the running track. Such water seepage then results in a buckling, or splitting apart of the butted joints of adjacent sections of the running track.

Moreover, such conventional synthetic running tracks are constructed with a top surface having a plurality of generally parallel grooves extending in a relatively longitudinal direction (the direction in which a user of such a surface would normally be running). These grooves serve a dual purpose; to help reduce slippage while running thereon, and, to add some resiliency to the top surface. Unfortunately, since most running tracks are installed to have a slight slope extending side-to-side (transversely), and because such synthetic running tracks are substantially impervious to water, the longitudinal grooves actually maintain water between them when, for example, it has rained, or after cleaning (rinsing off). This "trapped" water then dissipates only after an evaporation process has occurred.

To overcome the above-identified drawbacks, an object of the present invention is to provide an athletic flooring surface having a plurality of substantially parallel grooves configured in a transverse direction (as opposed to a longitudinal direction) of play. Such transverse grooves take advantage of the installed slope of the running track to facilitate drainage of water off of the entire running surface of the track.

Another object of the invention is to avoid splitting, or buckling of adjacent track sections by fabricating the track sections so that they have an overlapping configuration where they are joined together. In addition, because of such a configuration, adhesive can effectively be used between the joints without oozing of adhesive to the top surface, thereby maintaining a solid attachment therebetween.

Additional objects and advantages of this invention will become apparent from an examination of the drawings and the ensuing description.

SUMMARY OF THE INVENTION

The present invention is directed to an athletic flooring system for use on a supporting base structure comprising a resilient layer operatively positioned on the supporting structure, wherein the resilient layer includes a top playing surface and a bottom surface associated with the supporting base structure.

In one aspect of the present invention, the bottom surface includes a first side surface and a second side surface, wherein said sides extend in the longitudinal direction of the layer. The bottom surface also includes a first end surface and a second end surface, wherein said ends extend in the transverse direction of the layer.

According to another aspect of the present invention, the top playing surface of the athletic flooring system includes a drainage facilitating means associated with the top surface.

According to another aspect of the present invention, the resilient layer of the athletic flooring system is adhesively interconnected by a tongue and a groove with an adjacent resilient layer, wherein said layers are laid so as to form a continuous surface for running or playing.

According to another aspect of the present invention, the drainage facilitating means of the athletic flooring system have a plurality of substantially parallel spaced grooves, wherein said grooves extend in the transverse direction of the layer.

According to another aspect of the present invention, the drainage facilitating means of the athletic flooring system may have a dimple-like configuration associated with the top surface.

BRIEF DESCRIPTION OF THE DRAWINGS

The presently preferred embodiments of the invention are illustrated in the accompanying drawings and in which.

DESCRIPTION OF THE INVENTION

Figure 1:
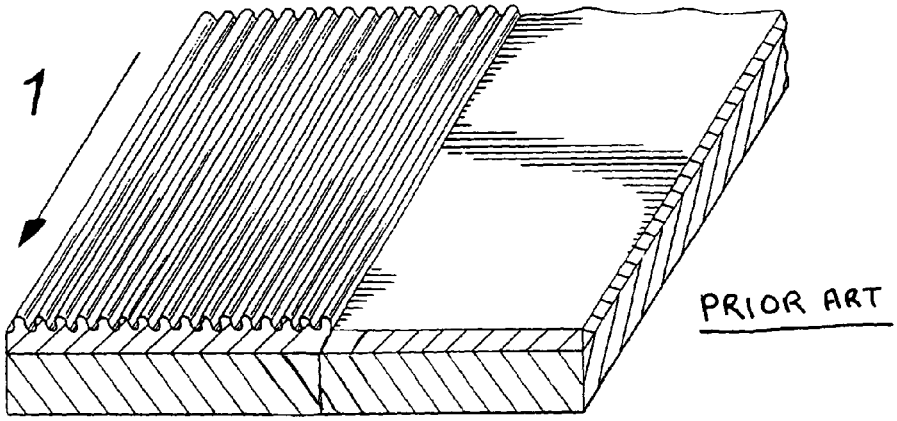
FIG. 1 is a perspective sectional view of the prior art.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
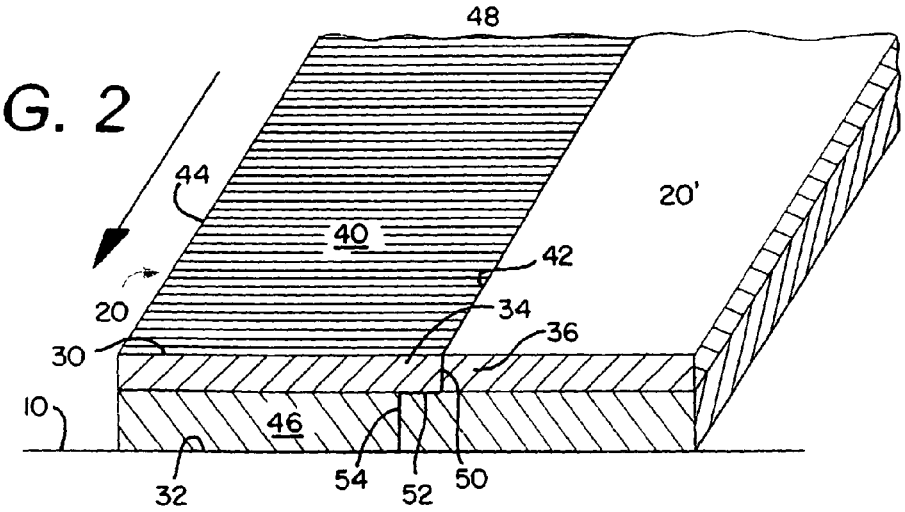
FIG. 2 is a perspective sectional view of the present resilient flooring system with parallel spaced grooves on the top surface extending in the transverse direction of play.
Figure 3:
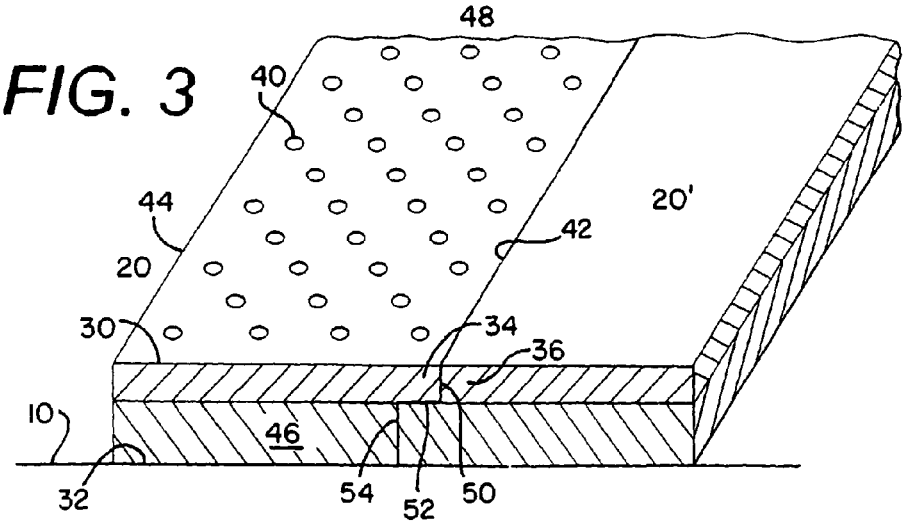
FIG. 3 is another perspective sectional view of the present resilient flooring system with a dimple-like configuration on the top surface of the running track.

As shown in FIGS. 2 and 3, the present invention is directed to an athletic flooring system for use on a supporting base structure (10) comprising a resilient layer (20) laid on the base surface (10) in side-by-side and end-to end fashion. The resilient layer (20) extends in the longitudinal direction of play. The resilient layer (20) includes a top playing surface (30), a bottom surface (32) associated with the supporting base structure (10), a first side surface (42) and a second side surface (44). Both sides are extended in the longitudinal direction of play. A first end surface (46) and a second end surface (48) are extended in the transverse direction of play.

As shown in FIG. 2, the top playing surface (30) is capable of having a plurality of substantially parallel spaced grooves (40) embossed, or otherwise formed on the top surface (30).

The grooves (40) are ideally extended continuously in the transverse direction of play. Because running tracks are generally sloped or inclined in the transverse direction of play, the grooves (40) act as channels to facilitate drainage of water off of the top surface (30).

While transverse grooves, or channels, as shown in FIG. 2, have been identified as a preferred structure to facilitate water run-off in a transverse direction, other types of drainage facilitating means are also contemplated, such as a dimple-like configuration (40) on the top surface of the running track in FIG. 3. The number, size and configuration of such dimples would be readily apparent to one having ordinary skill in the art, and recognizing the advantages of the teaching of the present disclosure.

Moreover, as shown in FIGS. 2 and 3, the resilient layer (20) is adhesively interconnected by a tongue (34) and a groove (36) connection with an adjacent resilient layer (20'). In this configuration, adhesives can be applied on selective surfaces on the tongue and the groove such as sections (50), (52) and (54). Thus, the present invention allows for easy application of adhesives without the disadvantage of excessive adhesives oozing out as mentioned above. As will be apparent to those skilled in the art, while tongue and groove configurations are contemplated in a preferred embodiment of the invention, other types of attachment could be used, providing these types still permit the application of adhesives and attain the objectives of this application. Furthermore, it is also contemplated that conventional track attachment methods be employed (without adhesive) provided means are provided to allow for the run-off of water transversely.

It should be emphasized that the above-described embodiments of the present invention, particularly, any "preferred" embodiments, are possible examples of implementations merely set forth for a clear understanding of the principles of the invention. Many variations and modification may be made to the above-described embodiment(s) of the invention without substantially departing from the spirit and principles of the invention. All such modifications are intended to be included herein within the scope of this disclosure and the present invention, and protected by the following claims.

What is claimed is:

1. An athletic track surface for use on a supporting base structure comprising:

a substantially continuous resilient layer including a plurality of operatively attached sections, each section including:

a top playing surface including a plurality of substantially parallel spaced grooves for facilitating drainage from the top surface;

a bottom surface substantially parallel to the top surface, the bottom surface being positioned proximate the base structure; and, a pair of opposing edges extending from the top and bottom surfaces, wherein each of the opposing edges including an edge surface attached and substantially perpendicular to the grooves, each edge surface including a plurality of planar segments that are substantially perpendicular to the top and bottom surfaces and capable of cooperative engagement with the edge surface of the opposing attached adjacent section.

2. The athletic track surface of claim 1, further comprising an adhesive affixed to at least a portion of at least one of the pair of opposing edges.

3. The athletic track surface of claim 1, wherein the edge surface of adjacent sections of the resilient layer form a tongue and a groove joint.

4. The athletic track surface of claim 1, wherein the supporting base structure is sloped in a direction substantially parallel with the grooves.

5. A method of providing an athletic track surface, the method comprising the steps of:

providing a sloped supporting base structure;

laying a substantially continuous resilient layer above the sloped supporting base structure, the resilient layer including a plurality of operatively attached sections, each section including:

a top playing surface including a plurality of substantially parallel spaced grooves for facilitating drainage from the top surface;

a bottom surface substantially parallel to the top surface, the bottom surface being positioned proximate the base structure; and, a pair of opposing edges extending from the top and bottom surfaces, wherein each of the opposing edges including an edge surface attached and substantially perpendicular to the grooves, each edge surface including a plurality of planar segments that are substantially perpendicular to the top and bottom surfaces and capable of cooperative engagement with the edge surface of the opposing attached adjacent section.

6. The method of claim 5, further comprising the step of affixing an adhesive to at least a portion of at least one of the pair of opposing edges.

7. The method of claim 6 further comprising laying each section of the resilient layer such that the substantially parallel spaced grooves extend in a direction substantially parallel with the slope of the supporting base structure.

8. The athletic track surface of claim 1, wherein the continuous resilient layer is fiberless.

9. The athletic track surface of claim 1, wherein the sections include a direction of play and the grooves run in a direction traverse the direction of play.

10. The method of claim 5, wherein the continuous resilient layer is fiberless.

11. The method of claim 5, wherein the sections include a direction of play and the grooves run in a direction traverse the direction of play.

12. An athletic track surface for use on a supporting base structure comprising:

a substantially fiberless continuous resilient layer including a plurality of operatively attached sections and having a direction of play, each section including:

a top playing surface including a plurality of substantially parallel spaced grooves for facilitating drainage from the top surface, the grooves running in a direction traverse the direction of play;

a bottom surface substantially parallel to the top surface, the bottom surface being positioned proximate the base structure; and, a pair of opposing edges extending from the top and bottom surfaces, wherein each of the opposing edges including an edge surface attached and substantially perpendicular to the grooves, each edge surface including a plurality of planar segments that are substantially perpendicular to the top and bottom surfaces and capable of cooperative engagement with the edge surface of the opposing attached adjacent section.

13. The athletic track surface of claim 12, further comprising an adhesive affixed to at least a portion of at least one of the pair of opposing edges.

14. The athletic track surface of claim 12, wherein the edge surface of adjacent sections of the resilient layer form a tongue and a groove joint.

15. The athletic track surface of claim 12, wherein the supporting base structure is sloped in a direction substantially parallel with the grooves.

* * * * *